United States Patent [19]

Hoshino

[11] Patent Number: 4,573,939

[45] Date of Patent: Mar. 4, 1986

[54] TOY MUSIC BOX

[76] Inventor: Chojiro Hoshino, 5-18-1 Kamimuneoka, Shiki-shi, Saitama-ken, Japan

[21] Appl. No.: 603,638

[22] Filed: Apr. 25, 1984

[30] Foreign Application Priority Data

Apr. 27, 1983 [JP] Japan ..... 58-63653[U]

[51] Int. Cl.[4] ..... A63H 13/02

[52] U.S. Cl. ..... 446/298; 446/303; 446/309; 446/357; 272/31 R

[58] Field of Search ..... 446/298, 297, 299, 300, 446/301, 302, 303, 332, 357, 358, 237, 238; 272/31 R, 31 P; 84/94 C, 95 C

[56] References Cited

U.S. PATENT DOCUMENTS

| | | | |
|---|---|---|---|
| 817,771 | 4/1906 | Helmer | 272/31 R |
| 1,342,577 | 6/1920 | Zion | 272/31 R |
| 1,529,976 | 3/1925 | West | 272/31 P |
| 2,158,052 | 5/1939 | Berger | 446/303 |
| 2,792,224 | 5/1957 | White | 272/31 R |
| 2,874,513 | 2/1959 | Connell | 446/332 |
| 3,247,683 | 4/1966 | Danker | 446/303 X |

FOREIGN PATENT DOCUMENTS

| | | | |
|---|---|---|---|
| 511085 | 10/1930 | Fed. Rep. of Germany | 272/31 R |
| 1318712 | 1/1963 | France | 272/31 R |
| 352221 | 3/1961 | Switzerland | 446/303 |

*Primary Examiner*—F. Barry Shay

*Attorney, Agent, or Firm*—Koda and Androlia

[57] ABSTRACT

A toy music box including a table having an ornament. The table is journaled in a freely rotatable manner and is rotated by the mechanism of the music box. The toy music box is designed such that a rod is journaled in a freely rotatable manner on the table at a position on the side and apart from a rotational shaft of the table, a free end of the rod is projected outside of the table to mount ornaments. The free end of the rod is constantly energized in the rotational direction of the table by an interposed spring, and a protruded part on the lower side of the rod is abutted against a plurality of projected edges erected on the upper periphery of the platform. The ornaments on the turntable and the rod make interesting movements with each other.

1 Claim, 9 Drawing Figures

TOY MUSIC BOX

BACKGROUND OF THE INVENTION

1. Field of the Invention

The present invention relates to a music box and more particularly to a toy music box having an ornament which rotates at a predetermined, constant speed and another ornament which makes intermittent movements.

2. Prior Art

The prior art toys or ornaments in general are so designed that they merely make regular and predetermined movements according to the music by making a turn and by moving their hands or legs.

They are limited as toys, therefore, in that people may lose interest in them in a short time due to the monotonous movement.

SUMMARY OF THE INVENTION

This invention concerns improvement for an ornament or a toy which is provided with music and mechanism of a music box which moves dolls, etc. by utilizing the driving force thereof.

This invention aims at providing a toy music box wherein more interesting and attractive movements are added to such monotonous prior art movements by unique movements created by such supplementary decorations as other animals or men, so that people may maintain their interest for a long time. In the toy music box according to this invention, a table is rotated by utilizing the music box so as to move a doll or other ornaments provided on the table to the accompaniment of the musical melody of the music box. A rod is further provided to move intermittently in accordance with the movements of the table and a doll, an animal, a traveling bag or other ornaments are provided on the rod.

DETAILED DESCRIPTION OF THE INVENTION

Figure 1:
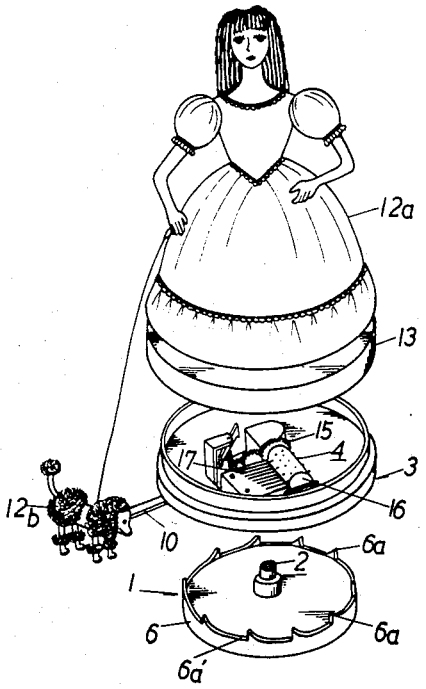
FIG. 1 is an exploded perspective view of a typical embodiment of a toy music box according to this invention.
Figure 2:
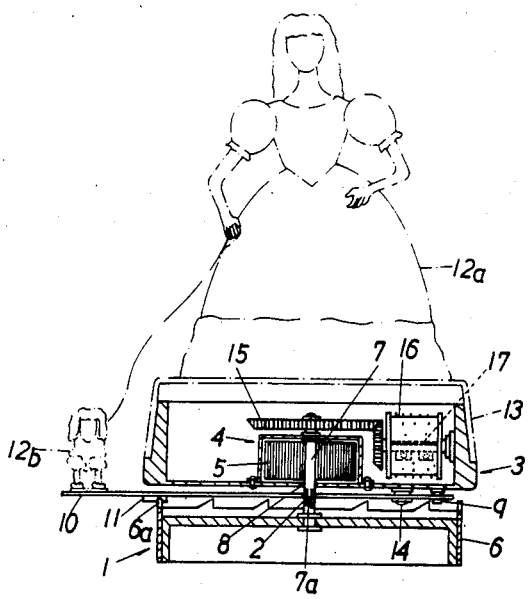
FIG. 2 is a cross sectional view of the essential portion of the embodiment of FIG. 1.
Figure 4:
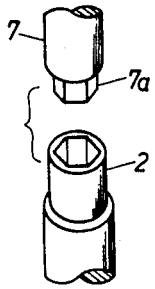
FIG. 4 is a perspective view of an essential part of a shaft which fixes a platform to a table.

Reference numeral 1 denotes a circular platform, on the center of which is erected a bearing pipe 2. Continuous and serrated edges 6*a* stand erect on the periphery of the platform 1. An annular member 6 having protrusions in the form of serrated edges 6*a* on the upper edge thereof is fitted to the platform 1 to provide the edges 6*a* in assembly. Reference numeral 3 denotes a turntable which is mounted on the platform 1 in such a manner to engage the shaft of the turntable 3 with the pipe 2 of the platform 1.

A music box 4 is mounted on the turntable 3. In an embodiment in which the turntable 3 is rotated (the most typical embodiment), a rod 7*a* of the lower end of a central shaft 7 (the revolving shaft of the music box) for mounting a spring coil 5 which drives the music box 4 projects downwardly through an opening 8 formed at the center of the turntable 3. The projected rod 7*a* is engaged with the pipe 2 of the platform 1.

As a result, rotational force is applied to the shaft 7 by the force of the spring 5, and the table 3 is made to rotate concurrently about the shaft 7 as the shaft 7 is engaged with the pipe 2.

The engagement of the pipe 2 and the shaft 7 is considered sufficient if the two move in an integral fashion at the time of engagement. For this purpose, the rod 7*a* and the pipe 2 are configured for male and female engagement.

An operation rod 10 is journaled by a shaft 14 at the lower surface of the turntable 3 in a manner to allow swinging movement of the rod 10. The free end of the rod 10 projects in the lateral direction from the table 3 while the rod 10 is pulled back by the spring 9 so that the free end of the rod 10 will be energized in the rotational direction of the table 3. A tapered member or protrusion 11 is mounted on the rod 10, and the rod 10 is journaled on the shaft 14 in a manner that the tapered member 11 abuts against serrated edges 6*a* of the platform 1.

The rod 10 is placed at the side of the rod 7 which is the shaft of the table 3. In other words, it is journaled on a shaft 14 at the position eccentric from the shaft of the table 3. The tapered member 11 provided on the rod 10 has a side which abuts the serrated edge 6*a* which is in the advancing direction of the table 3 and is tapered at a portion 11*a* along a longitudinal axis of the rod 10.

An ornament 12*b*, such as a dog or a car, is attached on the free end of the rod 10.

An ornamental table 13 is mounted on the turntable 3 in a freely detachable manner, and other ornament 12*a* such as a doll can be fixed on this table 3.

For assembling the platform 1 and the table 3, the serrated edge 6*a* of the platform 1 is provided with claw members which form a wall 6*a* vertical to the rotational direction of the table 3, and the tapered member 11 of the rod 10 which moves in accordance with the rotation of the table 3 abuts this vertical wall 6*a*'.

For assembling the platform 1 and the table 3, the pipe 2 is bored inside the shape of a square hole or a female screw while the rod 7 is shaped in a square bar or a male screw to obviate the misalignment of the two members. The table 3 can, therefore, rotate on the shaft on the platform 1.

When the toy music box of the structure above is operated with the force of the spring 5, the music box 4 plays the music, the table 3 is moved in the direction marked by the arrow y, the rod 10 journaled on the shaft 14 with the table 3 then moves in accordance with the movement of the table 3, and the tapered member 11 of the rod 10 abuts on the vertical wall 6*a*' of the serrated edge 6*a*. As the table 3 continues its rotation, the tapered members 11 are disengaged from the serrated edges 6*a*, since the position of the journal shaft 14 of the rod 10 is provided in an eccentric manner from the position of the rod 7*a* or the center of the rotation of the table 3. The rod 10 is then returned back to its original position by the spring 9.

Figure 3:
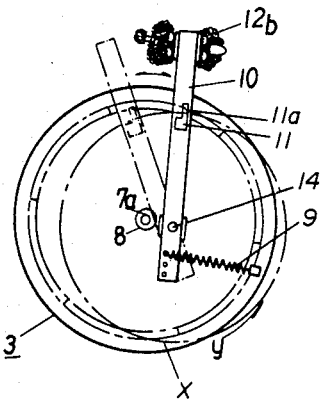
FIG. 3 is a bottom view of a table.

The mechanism will be explained in more detail with reference to FIG. 3. When the rotation of the table 3 is in the direction y, the locus of movement of the tapered member 11 which abuts the serrated edge 6*a* shall be x. At the points where this locus x and the ring with serrated edges 6*a* cross, they are engaged with each other while the rod 10 is free when they are separated.

A tapered portion 11*a* is provided on the tapered member 11 because the rod 10 which has been pulled back by the spring 9 shall always abut the serrated edge 6*a* on this tapered portion 11*a* and position of abutment shall gradually move laterally in accordance with the rotation of the table 3, thereby lowering the noise.

In the drawing, the reference numeral 15 denotes a gear of the music box, 16 a body of the music box, and 17 a vibrating plate.

Other embodiments are now explained referring to FIGS. 5 through 9.

Figure 5:
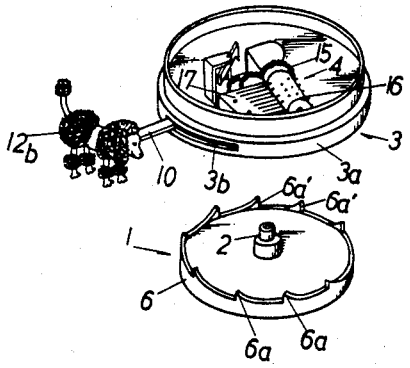
FIG. 5 is a perspective view of a table and a platform of another embodiment of this invention.

In an embodiment shown in FIG. 5, a slot 3*b* is provided on a side wall 3*a* of the table 3, and the rod 10 projects through this slot 3*b* towards the side of the table 3. It is so designed that the gap between the platform 1 and table 3 is minimized when they are attached together. As a result, the appearance and the operation become better because such a minimum gap eliminates vertical swing which might otherwise be caused by the rotation of the table. Absence of the gap space on the side contributes to better appearance.

Figure 6:
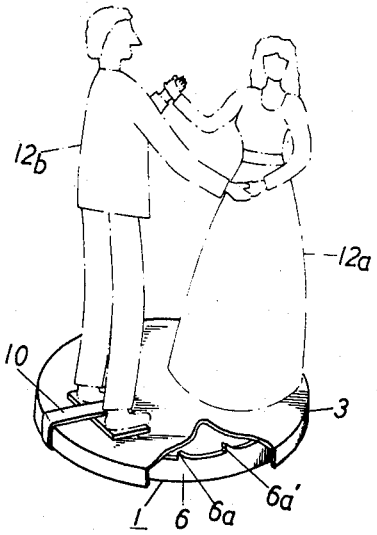
FIG. 6 is a partial cross sectional perspective view of another embodiment.

The embodiment shown in FIG. 6 is so designed that the ornaments 12*a* and 12*b* may be simultaneously mounted on the table 3 by bending an end of the rod 10 and extending the bent portion over the upper suface of the table 3.

Figure 7:
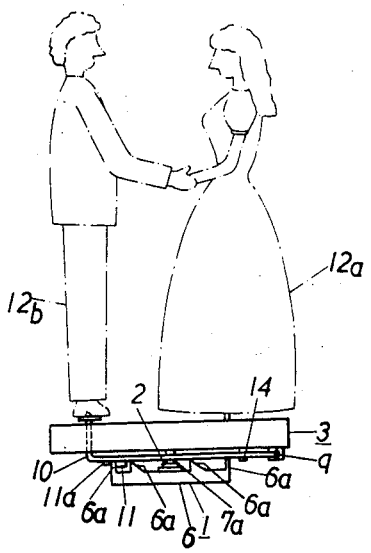
FIG. 7 is a side view of an essential portion of an embodiment similar to that of FIG. 6.
Figure 8:
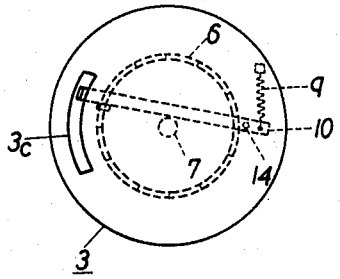
FIG. 8 is a plain view of the table of the embodiment in FIG. 7.

In the embodiment shown in FIGS. 7 and 8, a semicircular slot 3*c* is provided on the upper surface of the table 3, and the bent end of the rod 10 projects from the slot 3*c* to which the ornament 12*b* is attached.

Figure 9:
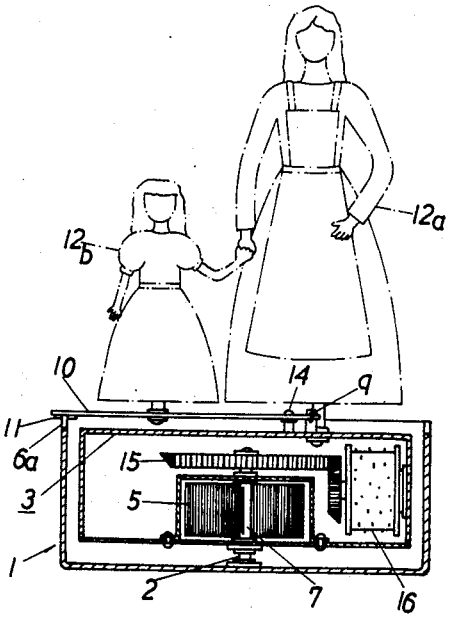
FIG. 9 is a cross sectional view of an essential portion of another embodiment of this invention.

In the embodiment shown in FIG. 9, the platform 1 is a bottomed-cylindrical container shape, and the table 3 and the music box 4 are provided therein. The rod 10 on the table 3 is provided in a manner that is successively abuts the serrated edge 6*a* on the periphery of the platform 1 and the ornament 12*a* is directly mounted on the table 3.

The above-mentioned music box 4 may be rotated by a motor or the like instead of the spring 5.

As a result of such construction, the ornament 12*a* starts its rotation at the same time as the table 3 rotates; but the ornament 12*b* remains stationary at the same position while the rod 10 is engaged with the serrated portion 6*a* and suspended. The ornament 12*b* suddenly moves forward by the force of the spring 9 when the rod 10 is disengaged from the serrated edge 6*a*, and this movement is repeated thereafter. In case of a doll accompanied by a dog, they create an interesting action as a toy as if the dog is running ahead or following the doll in a walk.

Since the serrated edges 6*a* have the vertical walls 6*a'*, the winding of the spring 5 is achieved by rotation of the platform 1.

The toy music box according to this invention can achieve the following effects due to its construction:

(1) In the embodiment shown in FIGS. 1 through 5, when the ornament 12*b* in the form of a dog or a child is attached on the rod 10, the dog or the child makes such a movement as if it jumps around the main doll. This is an interesting movement not observed in the conventional toys. When a traveling bag shape ornament is attached as the ornament 12*b*, the bag moves forward as it is pulled by the spring and is pulled intermittently in accordance with the stride of the main ornament.

(2) In the embodiments shown in FIGS. 6 through 9, the movements of more than one doll dancing together, a doll leading a child's hand, or the promenade of lovers, are effectively achieved.

In addition to the effects described in (1) and (2), more varied, more attractive, and more interesting movements can be produced by driving the music box and changing the figures of the ornaments 12*a* and 12*b*.

I claim:

1. A toy music box wherein a table having an ornament is rotatably coupled to a stationary platform and rotated by being driven in a first rotational direction relative to said platform by a driving means within said music box, the toy music box being characterized by:

a rod having one end rotatably coupled to said table at a point eccentric to the axis of rotation of said table, another end of said rod extending out beyond the edge of said table;

an ornament coupled to said another end of said rod;

a spring means attached to said table and coupled to said one end of said rod to bias said another end of said rod relative to said table in said first rotational direction;

a protrusion attached to said rod; and means including a plurality of protrusions provided on said platform for selectively engaging with said protrusion on said rod;

whereby said rod cyclically is stopped from rotating with said table in said first direction by said protrusion on said rod engaging with one of said plurality of protrusions on said platform as said base rotates and is then released after a predetermined rotation of said table to rotate in said first rotational direction, moving at first relative to said table and then therewith until said protrusion on said rod engages with another of said plurality of protrusions on said platform.

* * * * *